US011864706B2

(12) United States Patent
Son et al.

(10) Patent No.: US 11,864,706 B2
(45) Date of Patent: Jan. 9, 2024

(54) CONTROL METHOD OF DISHWASHER

(71) Applicant: LG Electronics Inc., Seoul (KR)

(72) Inventors: Changwoo Son, Seoul (KR); Byeongyong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 61 days.

(21) Appl. No.: 17/572,907

(22) Filed: Jan. 11, 2022

(65) Prior Publication Data

US 2022/0218176 A1 Jul. 14, 2022

(30) Foreign Application Priority Data

Jan. 11, 2021 (KR) ..... 10-2021-0003117

(51) Int. Cl.

| | |
|---|---|
| ***A47L 15/00*** | (2006.01) |
| ***A47L 15/22*** | (2006.01) |
| ***A47L 15/42*** | (2006.01) |

(52) U.S. Cl.

CPC ..... *A47L 15/0028* (2013.01); *A47L 15/0021* (2013.01); *A47L 15/0052* (2013.01); *A47L 15/22* (2013.01); *A47L 15/428* (2013.01); *A47L 15/4225* (2013.01); *A47L 15/4289* (2013.01); *A47L 15/4295* (2013.01); *A47L 2401/04* (2013.01); *A47L 2401/32* (2013.01); *A47L 2401/34* (2013.01); *A47L 2501/04* (2013.01); *A47L 2501/05* (2013.01); *A47L 2501/20* (2013.01); *A47L 2501/26* (2013.01)

(58) Field of Classification Search

None

See application file for complete search history.

(56) References Cited

U.S. PATENT DOCUMENTS

2020/0301382 A1 9/2020 Fawaz et al.

FOREIGN PATENT DOCUMENTS

| | | |
|---|---|---|
| EP | 0943287 | 9/1999 |
| EP | 2278422 | 1/2011 |

(Continued)

OTHER PUBLICATIONS

Kikukawa et al., "JP2008104475A English Machine Translation.pdf", May 8, 2008—Machine translation from Espacenet.com.*

(Continued)

*Primary Examiner* — Levon J Shahinian

(74) *Attorney, Agent, or Firm* — Fish & Richardson P.C.

(57) ABSTRACT

A method of controlling a dishwasher including a tub, at least one spray nozzle, a rack, and a microphone, includes: spraying, by the at least one spray nozzle, washing water while the at least one spray nozzle is rotating, analyzing a characteristic of a sound wave input to the microphone, the sound wave being generated based on the washing water colliding with one or more washing targets in the tub, determining whether a washing target made of a set material is present among the one or more washing targets based on the analyzed characteristic, determining, based on determining that the washing target made of the set material is present, a location in which the washing target made of the set material is present according to the analyzed characteristic, and reducing an amount of impact applied to the washing target made of the set material by the washing water.

19 Claims, 6 Drawing Sheets

(56) References Cited

FOREIGN PATENT DOCUMENTS

| | | |
|---|---|---|
| IT | PN960015 | 9/1997 |
| JP | 2008104475 | 5/2008 |
| KR | 19970073512 | 12/1997 |

OTHER PUBLICATIONS

Extended European Search Report in European Appln. No. 22150714.
8, dated Jun. 2, 2022, 13 pages.

* cited by examiner

CONTROL METHOD OF DISHWASHER

CROSS-REFERENCE TO RELATED APPLICATION

This application claims priority to and the benefit of Korean Patent Application No. 10-2021-0003117, filed in Korea on Jan. 11, 2021, the disclosure of which is incorporated herein by reference in its entirety.

TECHNICAL FIELD

The present disclosure relates to a method of controlling a dishwasher, and more particularly, to a method of controlling a dishwasher capable of suppressing damage to a washing target during operation of the dishwasher.

BACKGROUND ART

Contents described in this section merely provide background information on the present disclosure and do not constitute the related art.

In general, dishwashers are devices that spray washing water to accommodated dishes at a high pressure, wash the dishes, and then dry the dishes. In detail, the dishwashers are operated so that the washing water is sprayed at a high pressure into a tub in which the dishes are accommodated, and the sprayed washing water comes into contact with the dishes to wash foreign substances such as food waste stuck to the surfaces of the dishes.

The dishwasher generally includes the tub forming a washing chamber and a sump mounted on a bottom of the tub to store the washing water.

Further, the washing water is moved to a spray arm by pumping action of a washing pump mounted inside the sump, and the washing water having been moved to the spray arm is sprayed at a high pressure through a spray port formed in the spray arm.

Further, the washing water sprayed at a high pressure collides with the surface of the washing target, and thus dirt stuck to the washing target falls to the bottom of the tub.

Due to a difference of materials, some of the washing targets accommodated in the dishwasher collide with the washing water sprayed during a washing process and thus may be moved from original locations thereof or may be damaged.

Whether this serious problem occurs may be determined on the basis of, for example, sound waves generated inside the dishwasher during the washing process of the dishes.

Korean Patent Application Publication No. 10-1996-0016128, which is a related art, discloses a dish amount detection device and method for a dishwasher, which determines the amount of the dishes by detecting the volume of a sound generated when the washing water sprayed during the washing process collides with an inner surface of the tub.

However, the related art does not disclose any method of controlling a dishwasher, in which the dishes are suppressed from being moved from original locations thereof or being damaged as the dishes collide with the washing water, on the basis of a sound detected in a washing chamber.

SUMMARY

The present disclosure is directed to providing a method of controlling a dishwasher that may effectively suppress a dish made of a specific material from being moved or damaged due to the water pressure of washing water sprayed from the dishwasher.

The present disclosure is also directed to providing a method of controlling a dishwasher that may reduce the water pressure of the washing water sprayed from the spray nozzle when the spray nozzle approaches the dish made of the specific material.

The present disclosure is also directed to providing a method of controlling a dishwasher that may control a number of rotations of the washing motor to reduce the water pressure of the washing water sprayed from the spray nozzle.

The purposes of the present disclosure may be not limited to the purposes described above, and other purposes and advantages of the present disclosure that are not described may be understood by the following description and may be more clearly understood by embodiments of the present disclosure. Further, it may be easily identified that the purposes and advantages of the present disclosure may be implemented by units and combinations thereof described in the appended claims.

A dishwasher according to an embodiment may include a controller, a washing motor, a microphone, and a location sensor.

The controller may be provided in the dishwasher and control the operation of the dishwasher. To control the dishwasher, the controller may be connected to the washing motor, the microphone, the location sensor, and other components of the dishwasher so as to communicate therebetween in a wired or wireless manner.

The washing motor may be connected to the controller, and a rotational speed of the washing motor may be changed according to a command of the controller. The washing motor may be connected to the washing pump through a rotary shaft. The controller may control the rotational speed of the washing motor to control a rotational speed of the washing pump.

The controller may control the rotational speed of the washing pump to control a flow rate and a spray speed of the washing water sprayed from the spray nozzle and a water pressure of the washing water colliding with the dish.

The microphone may be provided in a tub and collect a sound wave generated when the disk held on the rack collides with the washing water. The microphone may be disposed at an appropriate location in which noise inside the tub may be collected without interfering with the operation of the spray nozzle inside the tub. The microphone may be connected to the controller and transmit a collected sound signal to the controller.

The location sensor may be mounted on the spray nozzle and detect a rotation angle of the spray nozzle. The location sensor may be connected to the controller and transmit location information on the spray nozzle to the controller.

The location sensor may be provided in each of a lower spray nozzle and an upper spray nozzle that rotate. In the dishwasher according to the embodiment, since a top spray nozzle is not rotated, the location sensor may be provided in each of the lower spray nozzle and the upper spray nozzle except for the top spray nozzle.

A method of controlling a dishwasher according to the embodiment may include the following operations.

The washing motor may be operated to spray the washing water to the dish held on the rack while the spray nozzle is rotated. The washing motor may be operated to spray the washing water to the dish held on the rack while the spray nozzle is rotated.

The controller may receive a sound signal from the microphone and analyze characteristics of the sound wave input to the microphone. The controller may analyze at least one of the amplitude or frequency of the sound wave input to the microphone. A set material of the washing target may be at least one of, for example, plastic or glass.

The controller may determine whether the washing target made of the set material is present on the basis of the analyzed characteristics of the sound wave. For example, the controller may determine that the washing target made of the set material is present when an impact sound generated in the washing target made of plastic or glass is detected through the analyzed sound wave.

The controller may determine whether the dish made of the set material is present on the basis of a currently collected sound wave by comparing stored data that is a comparison target with the currently collected sound wave.

The stored data that is the comparison target may be, for example, first data provided by collecting and storing the sound wave generated in the tub when the dishwasher is operated in a state in which the dish made of plastic or glass is not held on the rack.

When the first data is compared with the currently collected sound wave, for example, when at least one of the amplitude or frequency of the sound wave input to the microphone deviates from a set range in comparison to the characteristics of the sound wave when the washing target made of a pre-stored set material is not present, the controller may determine that the washing target made of the set material is present in the washing chamber.

In another embodiment, the stored data that is the comparison target may be second data provided by collecting and storing the sound wave generated in the tub when the dishwasher is operated in a state in which the dish made of plastic or glass is held on the rack.

When the second data is compared with the currently collected sound wave, for example, when at least one of the amplitude or frequency of the sound wave input to the microphone is within a set range in comparison to the characteristics of the sound wave when the washing target made of the pre-stored set material is present, the controller may determine that the washing target made of the set material is present in the washing chamber.

When the washing target made of the set material is present, the controller may determine a location in which the washing target made of the set material is present on the basis of the analyzed characteristics of the sound wave.

In the dishwasher according to the embodiment, a plurality of racks may be provided in the washing chamber in a vertical direction, a plurality of spray nozzles may be provided, and the spray nozzles may be arranged to correspond to the plurality of racks in the vertical direction.

The controller may determine whether the washing target made of the set material is present in any one rack among the plurality of racks by identifying whether the impact sound is generated when any one of the plurality of racks is operated.

When the dish made of the set material is present, the controller may reduce the amount of impact applied to the washing target made of the set material by the washing water sprayed from the spray nozzles.

In this case, at least one of a spraying amount and the spray speed of the washing water sprayed from the spray nozzle or a rotational speed of the spray nozzle is reduced, and thus the amount of impact applied to the washing target made of the set material may be reduced.

The controller may control the rotational speed of the washing motor to reduce at least one of the spray amount and the spray speed of the washing water sprayed from the spray nozzle or the rotational speed of the spray nozzle.

According to a method of controlling a dishwasher, in a dish washing process, a washing target made of a specific material may be effectively suppressed from being moved or damaged due to the washing water.

Further, according to the method of controlling a dishwasher, when the impact sound is generated by the dish held on the rack and made of plastic or glass, the controller may reduce the rotational speed of the washing motor to reduce the amount of impact applied to the dish by the washing water and thus may effectively suppress the dish made of plastic or glass from being moved from an original location thereof or being damaged due to the water pressure of the washing water.

Further, according to the method of controlling a dishwasher according to the present disclosure, the controller may reduce the rotational speed of the washing motor when the spray nozzle passes through the dish made of plastic or glass, and thus a washing time can be reduced and washing efficiency can be increased, as compared to a case in which the overall rotational speed of the washing motor is reduced uniformly.

In addition to the above-described effects, the detailed effects of the present disclosure will be described together while specific details for implementing the disclosure are described below.

DETAILED DESCRIPTION OF EXEMPLARY EMBODIMENTS

Figure 1:
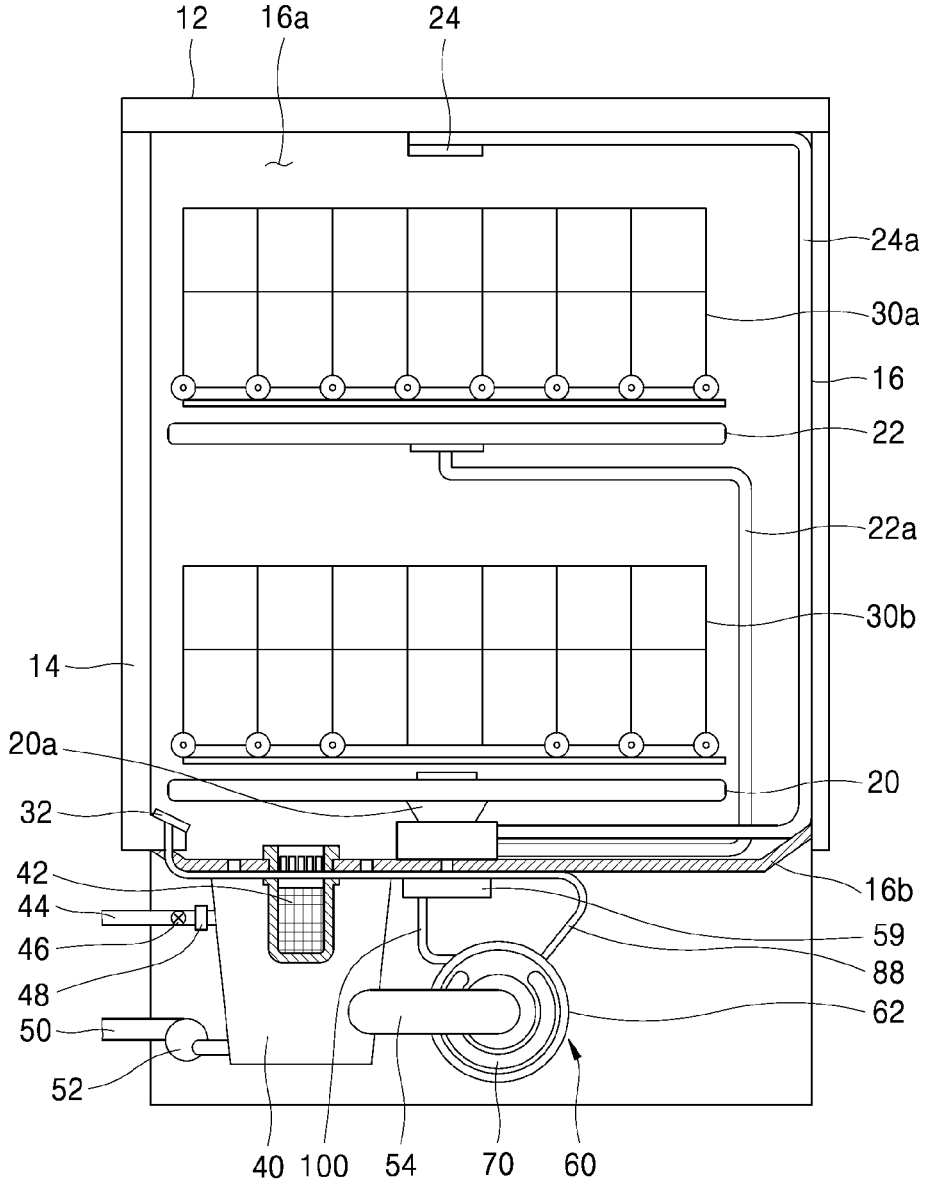
FIG. 1 is a schematic cross-sectional view of a dishwasher according to an embodiment.

The above-described purposes, features, and advantages will be described in detail with reference to the accompanying drawings, and accordingly, those skilled in the art to which the present disclosure pertains may easily implement the technical spirit of the present disclosure. In the description of the present disclosure, when it is determined that a detailed description of widely known technologies related to the present disclosure may make the subject matter of the present disclosure unclear, the detailed description be omitted. Hereinafter, embodiments of the present disclosure will be described in detail with reference to the accompanying drawings. In the drawings, the same reference numerals are used to indicate the same or similar components.

Although first, second, and the like are used to describe various components, it is apparent that these components are not limited by these terms. These terms are only used to distinguish one component from another component, and it is apparent that a first component may be a second component unless particularly otherwise stated.

Throughout the specification, unless particularly otherwise stated, each component may be singular or plural.

Singular expressions used herein include plural expressions unless clearly otherwise indicated in the context. In the present application, terms such as "configuring" or "including" should not be interpreted as necessarily including all of various components or various steps described in the specification and should be interpreted as not including some components or some steps thereof or further including additional components or additional steps.

Throughout the specification, when "A and/or B" is used, this means A, B or A and B unless otherwise stated, and when "C to D" is used, this means that a value is greater than or equal to C and less than or equal to D unless otherwise stated.

FIG. 1 is a schematic cross-sectional view of a dishwasher according to an embodiment.

The dishwasher according to the present embodiment includes a case 12 forming an exterior, a tub 16 provided inside the case 12 and forming a washing chamber 16*a* in which a washing target is accommodated, a door 14 that is provided on a front surface of the tub 16 and opens or closes the washing chamber 16*a*, and a sump 40 which is disposed below the tub 16 and in which washing water is stored.

A filter 42 for filtering the washing water supplied from an external unit or the washing water introduced from the tub 16 may be provided in the sump 40 according to the present embodiment.

The dishwasher according to the present embodiment includes one or more spray nozzles 20, 22, and 24 that are rotatably provided in the washing chamber 16*a* and spray the washing water to the washing chamber 16*a* in the tub 16, a washing pump 60 that supplies the washing water stored in the sump 40 to the one or more spray nozzles 20, 22, and 24, a switching valve 59 for connecting the washing water supplied from the washing pump 60 to at least one of the spray nozzles 20, 22, and 24, and racks 30*a* and 30*b* which are accommodated in the washing chamber 16*a* and on which the washing target is held.

The racks 30*a* and 30*b* according to the present embodiment may have a structure on which the washing target is held so that the washing target is washed using the washing water sprayed by the plurality of spray nozzles 20, 22, and 24, and may include an upper rack 30*a* disposed on an upper side with respect to a location disposed inside the washing chamber 16*a* and a lower rack 30*b* disposed on a lower side with respect to the location.

The plurality of spray nozzles 22, 22, and 24 may be vertically arranged. The plurality of spray nozzles 20, 22, and 24 according to the present embodiment include a lower spray nozzle 20 that is disposed at a lowermost end and sprays the washing water from the lower side to the upper side toward the lower rack 30*b*, an upper spray nozzle 22 that is disposed between the upper rack 30*a* and the lower rack 30*b* and sprays the washing water to the lower rack 30*b* and the upper rack 30*a*, and a top spray nozzle 24 that is disposed at an upper end of the washing chamber 16*a* which is the upper side of the upper rack 30*a* and that sprays the washing water to a space of the washing chamber 16*a*. The plurality of spray nozzles 20, 22, and 24 may receive the washing water from the washing pump 60 through a plurality of spray nozzle connection pipes 20*a*, 22*a*, and 24*a*.

The switching valve 59 may selectively supply the washing water pumped by the washing pump 60 to at least one of the lower spray nozzle 20, the upper spray nozzle 22, and the top spray nozzle 24. The switching valve 59 may selectively connect a washing water supply pipe 100, in which the washing water discharged from the washing pump 60 flows, and at least one of the plurality of spray nozzle connection pipes 20*a*, 22*a*, and 24*a*.

The washing pump 60 may be connected to the sump 40 through a water collection pipe 54 having a water collection passage formed therein. A valve that opens or closes a space between the sump 40 and the washing pump 60 may be disposed in an inlet of the water collection pipe 54 or the washing pump 60.

The dishwasher according to the present embodiment may include a water supply assembly that supplies the washing water into the dishwasher and a drainage assembly that drains water stored inside the dishwasher.

The water supply assembly according to the present embodiment may include a water supply pipe 44 forming a water supply passage to which the washing water is supplied from an external water source, a water supply valve 46 that opens or closes the water supply passage formed in the water supply pipe 44, and a flow meter 48 that measures the flow rate of the washing water flowing to the sump 40 through the water supply passage.

The drainage assembly according to the present embodiment may include a drainage pipe 50 that has a drainage passage formed therein to guide the water stored in the sump 40 to the outside and a drainage pump 52 that is disposed on the drainage passage formed in the drainage pipe 50 and drains the washing water in the sump 40 to the outside. The drainage pump 52 may include a drainage motor that generates a rotational force.

The washing pump 60 according to the present embodiment may be coupled to the sump 40 and may be connected to the spray nozzles 20, 22, and 24 and a steam nozzle 32.

The washing pump 60 according to the present embodiment may supply the water stored in the sump 40 to the plurality of spray nozzles 20, 22, and 24 or generate steam to supply the generated steam to the steam nozzle 32. The steam nozzle 32 may supply the steam to the washing chamber 16*a*.

The dishwasher may further include the water collection pipe 54 and the washing water supply pipe 100. The water collection pipe 54 may connect the sump 40 and the washing pump 60. The water collection pipe 54 may connect the washing pump 60 and the spray nozzles 20, 22, and 24.

The washing pump 60 according to the present embodiment is connected to the sump 40 through the water collection pipe 54. The washing pump 60 according to the present embodiment may be connected to the switching valve 59 and the spray nozzles 20, 22, and 24 through the washing water supply pipe 100 and may be connected to the steam nozzle 32 through a steam supply pipe 88.

The washing pump 60 according to the embodiment of the present disclosure may include a housing 62 that is coupled to the sump 40 and forms an exterior of the washing pump 60, an impeller 64 that is disposed inside the housing 62 and forms a flow of the washing water stored inside the housing 62, a washing motor 65 that rotates the impeller 64, and a heater 70 that is mounted on the outside of the housing 62 of the washing pump 60 and heats the washing water to generate the steam.

The washing pump 60 may be connected to the spray nozzles 20, 22, and 24 and may supply the washing water to the spray nozzles 20, 22, and 24. The washing motor 65 may be connected to the washing pump 60 through a rotary shaft and may provide a rotational force to the washing pump 60.

When the drainage pump 52 and the washing motor 65 are stopped, that is, are not operated, the washing pump 60 may store the washing water inside the housing 62. In this case, the heater 70 heats the stored washing water to generate the steam.

The washing water flowing inside the dishwasher according to the present embodiment may flow through the sump 40 and the tub 16 to wash the washing target. Further, the washing water stored in the sump 40 may be supplied from an external water source through the water supply assembly and may be discharged to the outside through the drainage assembly.

The washing water stored in the sump 40 may flow into the tub 16 as the washing motor 65 of the washing pump 60 rotates the impeller 64. That is, by operating the washing motor 65, the washing water inside the sump 40 may flow into the washing pump 60, may be pumped from the washing pump 60 to the switching valve 59, and may flow to at least one of the plurality of spray nozzles 20, 22, and 24.

The washing water stored in the sump 40 flows into the housing 62 through the water collection pipe 54 connected to the washing pump 60. Further, the washing water may flow to the switching valve 59 through the washing water supply pipe 100 connected to the washing pump 60.

The sump 40 and the washing pump 60 are connected through the water collection pipe 54, and the washing pump 60 and the switching valve 59 are connected through the washing water supply pipe 100. The switching valve 59 may be connected to the plurality of spray nozzles 20, 22, and 24 through the respective connection pipes 20*a*, 22*a*, and 24*a*, and the switching valve 59 supplies the washing water pumped by the washing pump 60 to at least one of the spray nozzles 20, 22, and 24.

The washing water sprayed into the tub 16 through the spray nozzles 20, 22, and 24 may flow into the sump 40 through a hole formed in a bottom part 16*b* of the tub 16.

The steam flowing inside the dishwasher according to the present embodiment is generated by the washing pump 60. The heater 70 is operated to generate the steam using the washing water that is present inside the housing 62 of the washing pump 60. In this case, it is preferable that the flow of the washing water inside the washing pump 60 is minimized.

Thus, when the steam is generated inside the housing 62 of the washing pump 60, it is appropriate to stop the operation of the washing motor 65 and the impeller 64. Alternatively, it is appropriate to rotate the impeller 64 at a set rotational speed or less even when the washing motor 65 is operated.

The steam generated in the washing pump 60 may flow to a steam supply pipe 88 connected to the washing pump 60 and may flow into the washing chamber 16*a*.

Figure 2:
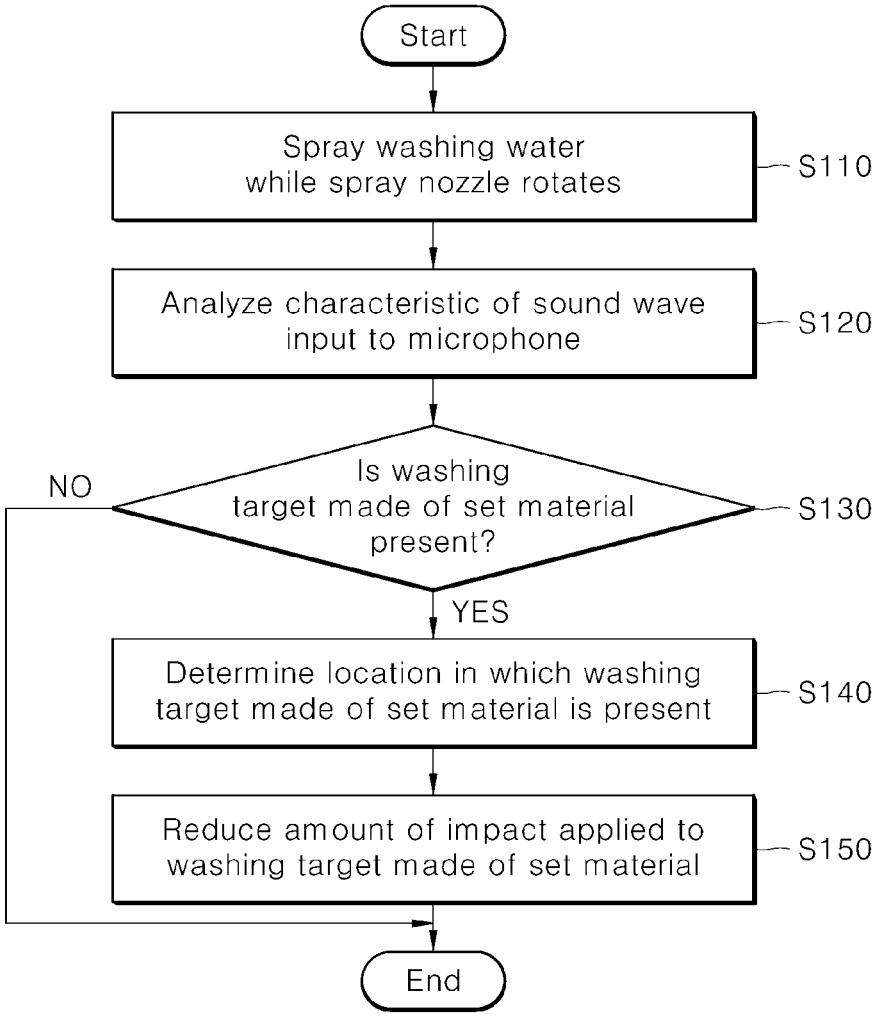
FIG. 2 is a flowchart for describing a method of controlling a dishwasher according to the embodiment.
Figure 3:
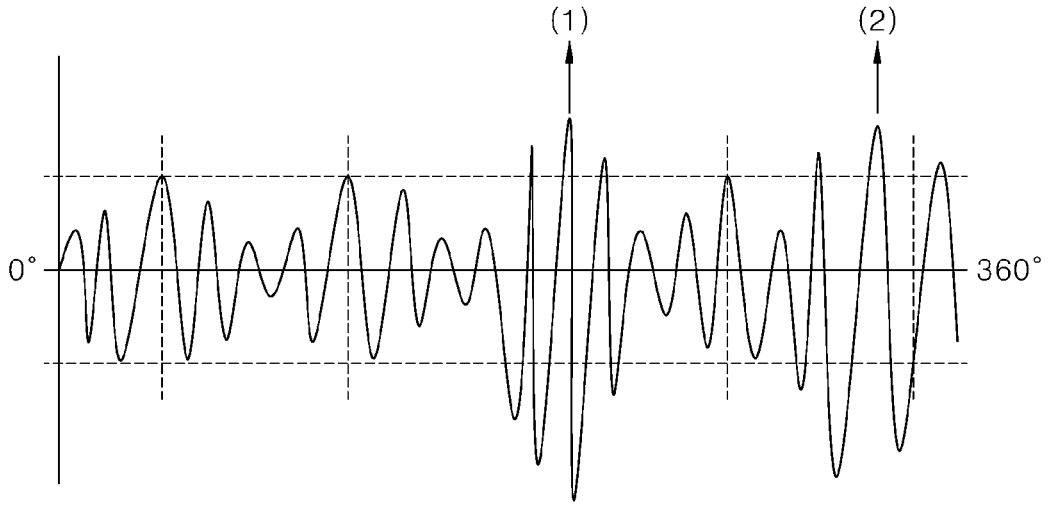
FIG. 3 is a graph showing a waveform of a sound wave according to a change in rotation angle of a spray nozzle, the sound wave being input by a microphone provided in the dishwasher.
Figure 4:
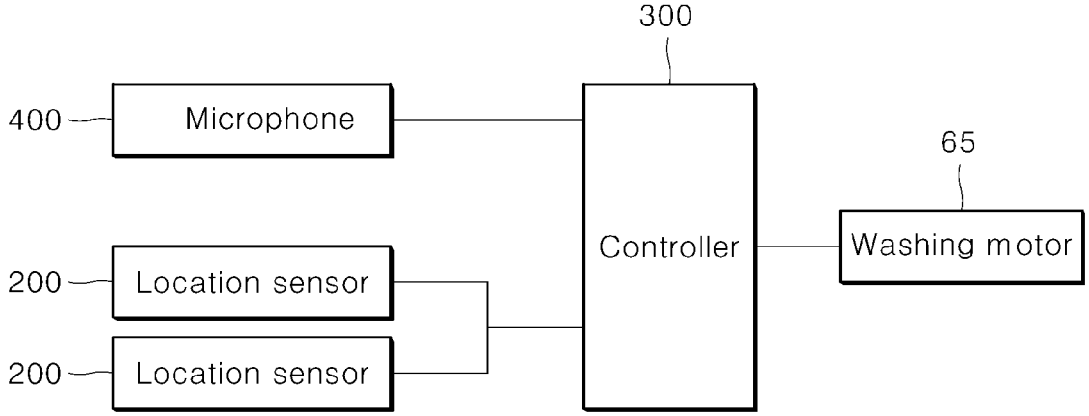
FIG. 4 is a view for describing a configuration for controlling the dishwasher according to the embodiment.

FIG. 2 is a flowchart for describing a method of controlling a dishwasher according to the embodiment. FIG. 3 is a graph showing a waveform of a sound wave according to a change in rotation angle of a spray nozzle, the sound wave being input by a microphone 400 provided in the dishwasher. FIG. 4 is a view for describing a configuration for controlling the dishwasher according to the embodiment.

When the dishwasher is operated, the washing water sprayed from the spray nozzles may collide with the washing targets, for example, dishes, plates, glasses, spoons, and chopsticks, held on the racks. In this case, the dish with which the sprayed washing water collides may receive a serious impact according to a material.

For example, since the dish made of plastic is light, the dish may be moved from an original location thereof on the rack due to the water pressure of the sprayed washing water. When the dish is moved, the dish may overlap other dishes, and accordingly, the dish held on the rack may not be washed well.

Further, for example, a glass dish such as a wine glass may be shaken due to the water pressure of the sprayed washing water, may collide with other dishes held on the rack, and thus may be damaged.

The embodiment provides a method of controlling a dishwasher that may effectively suppress a dish made of a specific material such as plastic or glass from being moved or damaged due to the water pressure of the washing water sprayed from the dishwasher.

First, a configuration for controlling the dishwasher will be described with reference to FIG. 4. A system for controlling the dishwasher may include a controller 300, a washing motor 65, a microphone 400, and location sensors 200.

The controller 300 may be provided in the dishwasher and control the operation of the dishwasher. To control the dishwasher, the controller 300 may be connected to the washing motor 65, the microphone 400, the location sensor 200, and other components of the dishwasher so as to communicate therebetween in a wired or wireless manner.

The washing motor 65 may be connected to the controller 300, and a rotational speed of the washing motor 65 may be changed according to a command of the controller 300. Further, the washing motor 65 may be connected to the washing pump 60 through a rotary shaft. Thus, the controller 300 may control the rotational speed of the washing motor 65 to control a rotational speed of the washing pump 60.

The controller 300 may control the rotational speed of the washing pump 60 to control a flow rate and a spray speed of the washing water sprayed from the spray nozzles and a water pressure of the washing water colliding with the dish.

The microphone 400 may be provided in the washing chamber 16*a* and collect the sound wave generated when the washing water collides with the dish held on the rack. The microphone 400 may be disposed at an appropriate location in which noise inside the washing chamber 16*a* may be collected without interfering with the operation of the spray nozzles inside the washing chamber 16*a*. The microphone 400 may be connected to the controller 300 to transmit a collected sound signal to the controller 300.

The location sensor 200 may be mounted on the spray nozzles and detect rotation angles of the spray nozzles. The location sensor 200 may be connected to the controller 300 and transmit location information on the spray nozzles to the controller 300. The location sensor 200 may be provided as, for example, a Hall sensor, but the present disclosure is not limited thereto.

The location sensors 200 may be provided in the lower spray nozzle 20 and the upper spray nozzle 22 that rotate. In the dishwasher according to the embodiment, since the top spray nozzle 24 is not rotated, the location sensors 200 may be provided in the lower spray nozzle 20 and the upper spray nozzle 22 excluding the top spray nozzle 24.

Hereinafter, a method of controlling the dishwasher will be described in detail. Referring to FIG. 2, while the washing motor 65 is operated to rotate the spray nozzles, the washing water may be sprayed onto the dish held on the rack (S110). In this case, the microphone 400 provided in the washing chamber 16*a* may collect noise, that is, the sound wave, which is generated while the washing water collides with the dish.

The controller 300 may receive the sound signal from the microphone 400 and analyze characteristics of the sound wave input to the microphone 400 (S120). The controller 300 may analyze at least one of the amplitude or the frequency of the sound wave input to the microphone 400. In this case, a set material of the washing target may be at least one of, for example, plastic or glass.

The controller 300 may determine whether the washing target made of the set material is present on the basis of the analyzed characteristics of the sound wave (S130). For example, the controller 300 may determine that the washing target made of the set material is present when an impact sound generated in the washing target made of plastic or glass is detected through the analyzed sound wave.

A light dish made of plastic may generate the impact sound while being moved due to the water pressure of the washing water and colliding with other dishes held on the rack. Further, a dish made of glass may generate the impact sound while being shaken due to the water pressure of the sprayed washing water and colliding with other dishes held on the racks.

The controller 300 may determine whether the dish made of the set material such as plastic or glass is present by analyzing the amplitude and the frequency of the collected sound wave. The controller 300 may determine whether the dish made of the set material is present on the basis of a currently collected sound wave by comparing stored data that is a comparison target with the currently collected sound wave.

The data that is the comparison target may be stored in a storage device provided in the dishwasher. Alternatively, the dishwasher may be communicatively connected to a server, and the data that is the comparison target may be stored in the server.

In this case, the stored data that is the comparison target may be, for example, first data provided by collecting and storing the sound wave generated in the washing chamber 16*a* when the dishwasher is operated in a state in which the dish made of plastic or glass is not held on the rack.

When the first data is compared with the currently collected sound wave, for example, when at least one of the amplitude or frequency of the sound wave input to the microphone 400 deviates from a set range in comparison to the characteristics of the sound wave when the washing target made of a pre-stored set material is not present, the controller 300 may determine that the washing target made of the set material is present in the washing chamber.

In another embodiment, the stored data that is the comparison target may be second data provided by collecting and storing the sound wave generated in the washing chamber 16*a* when the dishwasher is operated in a state in which the dish made of plastic or glass is held on the rack. The second data may include the impact sound generated by the dish made of plastic or glass.

When the second data is compared with the currently collected sound wave, for example, when at least one of the amplitude or frequency of the sound wave input to the microphone 400 is within a set range in comparison to the characteristics of the sound wave when the washing target made of the pre-stored set material is present, the controller 300 may determine that the washing target made of the set material is present in the washing chamber.

When operation S130 is performed using the first data or the second data and when the impact sound is not generated in the currently collected sound wave, the controller 300 may determine that the washing target made of the set material is not present regardless of whether the washing target made of the set material is actually present.

In this case, since the dish made of the set material is sufficiently heavy or is stably supported on the rack, the impact sound is not generated. Thus, the dish made of plastic is not moved or the dish made of glass is not damaged due to an impact. Thus, there is no need to perform operations S140 and S150 on the premise that the washing target made of the set material is present.

In another embodiment, the controller 300 may determine whether the dish made of plastic or glass is present on the basis of characteristics of the sound wave generated when the washing water collides with the dish made of plastic or glass.

That is, data related to the amplitude or frequency of the sound wave generated when the washing water collides with the dish made of plastic or glass is stored, and the controller 300 may determine whether the dish made of plastic or glass is currently present in the dishwasher by comparing the currently collected sound wave with the stored data.

According to this method, even when the impact sound is not generated, the controller 300 may determine whether the washing target made of the set material is present in the rack.

Further, according to this method, regardless of whether the impact sound is generated, the controller 300 may or may not perform operations S140 and S150 according to whether the dish made of the set material is actually present in the rack.

Meanwhile, in performing operation S130, a series of processes of collecting, processing, and storing data for comparison, comparing the stored data with the currently collected sound wave, and determining whether the dish made of the set material is present may be performed using machine learning and deep learning.

When it is determined that the washing target made of the set material is not present, the controller 300 may terminate the control process of the dishwasher. When it is determined that the washing target made of the set material is present, the controller 300 may perform operations S140 and S150.

When the washing target made of the set material is present, the controller 300 may determine a location in which the washing target made of the set material is present, on the basis of the analyzed characteristics of the sound wave (S140).

FIG. 3 illustrates a waveform of a currently input sound wave. In the graph of FIG. 3, a horizontal axis represents the change in rotation angle of the spray nozzle, and a vertical axis represents the amplitude.

In the horizontal axis, 0° is a reference angle, and 360° indicates a state in which the spray nozzle is rotated once and is located at the reference angle again. The rotation angle of the spray nozzle may be determined using the location sensor 200 disposed at each spray nozzle.

When the spray nozzle is rotated, the controller 300 may determine the location in which the washing target made of the set material is present on the same rack on the basis of the rotation angle and a time point at which the impact sound is generated.

In FIG. 3, it may be seen that, in particular, the amplitude is significantly changed at locations (1) and (2) as compared to locations at other angles. That is, in the locations (1) and (2), since the washing water collides with the dish made of plastic or glass, the impact sound is generated.

Thus, the controller 300 may determine that the dish made of a specific material is present in the rack in operation S130 and may determine that the dish made of the specific material is present in locations corresponding to the angles at locations (1) and (2) in operation S140.

In the dishwasher according to the embodiment, the plurality of racks may be provided in the washing chamber in a vertical direction, a plurality of spray nozzles may be provided, and the spray nozzles may be arranged to correspond to the plurality of racks in the vertical direction.

The controller 300 may determine in which rack among the plurality of racks the washing target made of the set material is present by identifying whether the impact sound is generated when any one of the plurality of racks is operated.

Referring to FIG. 1, the rack may include the upper rack 30*a* and the lower rack 30*b*, and the spray nozzles may include the upper spray nozzle 22 and the lower spray nozzle 20. In this case, the upper spray nozzle 22 may be disposed to correspond to the upper rack 30*a* in the vertical direction, and the lower spray nozzle 20 may be disposed to correspond to the lower rack 30*b* in the vertical direction.

Due to this structure, when the impact sound is generated by spraying the washing water to the upper rack 30*a* through the upper spray nozzle 22, it may be determined that the dish made of plastic or glass is present in the upper rack 30*a*. Further, when the impact sound is generated by spraying the washing water to the lower rack 30*b* through the lower spray nozzle 20, it may be determined that the dish made of plastic or glass is present in the lower rack 30*b*.

In order to determine whether a dish made of a specific material is present in the upper rack 30*a*, the lower rack 30*b*, or both the upper rack 30*a* and the lower rack 30*b*, the controller 300 may control the switching valve 59 so that the washing water is sprayed from only the upper spray nozzle 22 or from only the lower spray nozzle 20.

In the above-described manner, the controller 300 may accurately determine in which rack among the upper rack 30*a* or the lower rack 30*b* the dish made of the set material is present and may also determine a location in which the dish is present by collecting the rotation angles of the spray nozzles.

When the dish made of the set material is present, the controller 300 may reduce the amount of impact applied to the washing target made of the set material by the washing water sprayed from the spray nozzles (S150).

In this case, at least one of a spraying amount and the spray speed of the washing water sprayed from the spray nozzle or a rotational speed of the spray nozzle is reduced, and thus the amount of impact applied to the washing target made of the set material may be reduced.

The controller 300 may control the rotational speed of the washing motor 65 to reduce at least one of the spray amount and the spray speed of the washing water sprayed from the spray nozzle or the rotational speed of the spray nozzle.

When the controller 300 controls the rotational speed of the washing motor 65 to be reduced, the spray amount and the spray speed of the washing water sprayed from the spray nozzle may be reduced, and the rotational speed of the spray nozzle may be also reduced. Accordingly, the amount of the impact applied to the dish made of the set material may be reduced.

Figure 5:
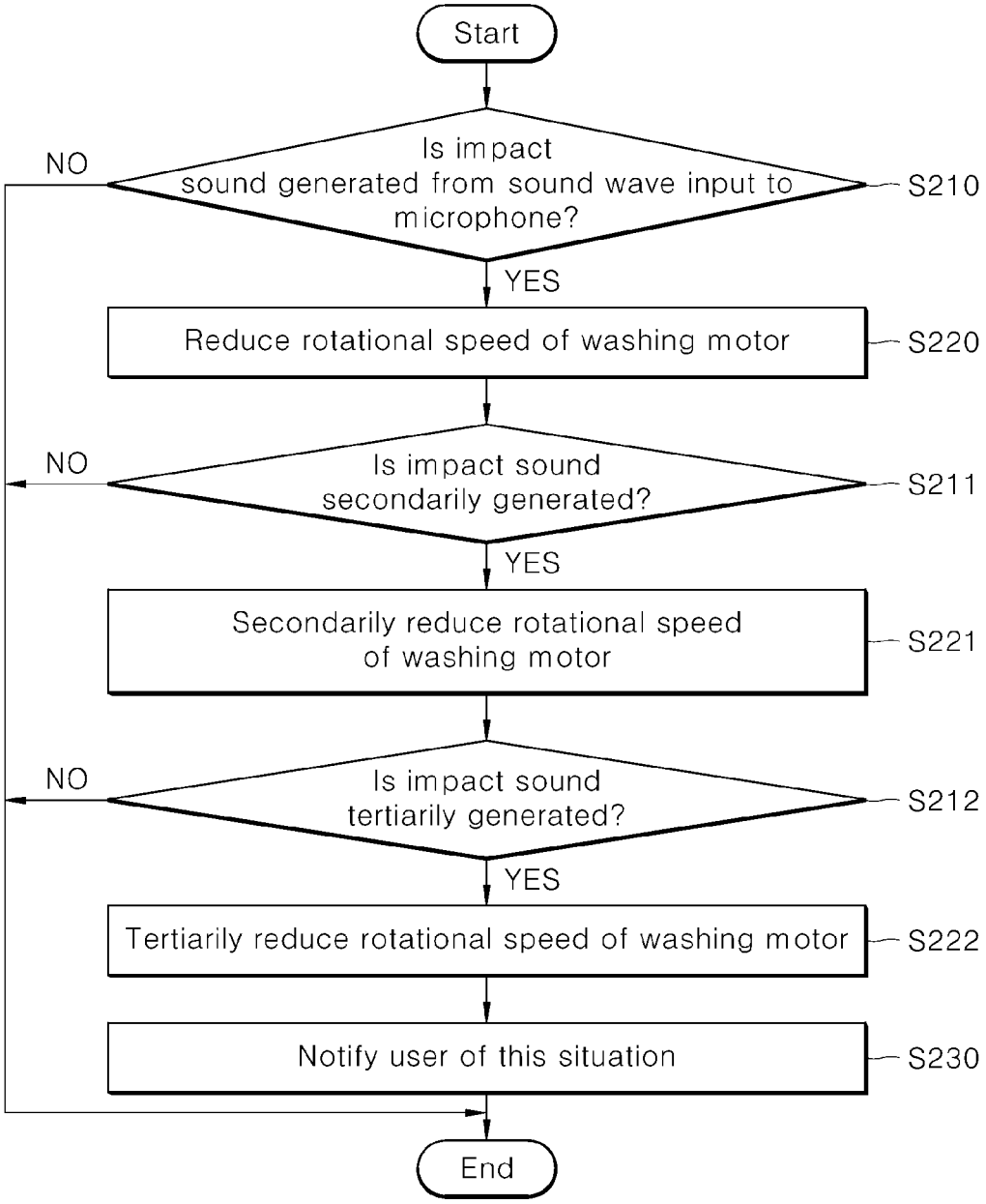
FIG. 5 is a flowchart for describing a method of controlling a dishwasher according to another embodiment.

FIG. 5 is a flowchart for describing a method of controlling a dishwasher according to another embodiment. FIG. 5 illustrates a method in which the controller 300 controls the rotational speed of the washing motor 65 according to another embodiment.

The controller 300 may determine whether the impact sound is generated from the sound wave input to the microphone 400 (S210). Since operation S210 is an embodiment of operation S130 described above, operation S210 may be performed in operation S130 without a separate process. When the impact sound is not generated, the controller 300 may terminate the process without reducing the rotational speed of the washing motor 65.

When the impact sound is generated, the controller 300 may reduce the rotational speed of the washing motor 65 (S220). The controller 300 may reduce the rotational speed of the washing motor 65 to reduce the amount of impact applied to the dish made of the specific material and caused by the washing water, thereby suppressing movement or damage of the dish made of the specific material. A rotational speed reduction ratio of the washing motor 65 may be appropriately set.

In operation S220 and operations S221 and S222 described below, the overall rotational speed of the washing motor 65 may be reduced without considering a location in which the impact sound is generated.

In this case, the determination of whether the impact sound is generated and the reduction of the rotational speed of the washing motor 65 may be alternately performed multiple times. The determination of whether the impact sound is generated and the reduction of the rotational speed of the washing motor 65 may be set to an appropriate number of times. In the embodiment, the number of repetitions is set to three, but the present disclosure is not limited thereto.

After performing operation S220, the controller 300 may secondarily determine whether the impact sound is generated from the sound wave input to the microphone 400 (S211). When the impact sound is not generated in operation S211, the controller 300 may terminate the process without reducing the rotational speed of the washing motor 65.

When the impact sound is generated, the controller 300 may secondarily reduce the rotational speed of the washing motor 65 (S221). In this case, the rotational speed of the washing motor 65 after operation S221 is performed is further reduced as compared to the rotational speed of the washing motor 65 after operation S220 is terminated.

After performing operation S221, the controller 300 may tertiarily determine whether the impact sound is generated from the sound wave input to the microphone 400 (S212). When the impact sound is not generated in operation S212, the controller 300 may terminate the process without reducing the rotational speed of the washing motor 65.

When the impact sound is generated, the controller 300 may tertiarily reduce the rotational speed of the washing motor 65 (S222). In this case, the rotational speed of the washing motor 65 after operation S222 is terminated is further reduced as compared to the rotational speed of the washing motor 65 after operation S221 is terminated.

When the impact sound is generated even after the rotational speed of the washing motor 65 is reduced, the controller 300 may notify a user of this situation (S230).

In detail, the controller 300 may determine whether the impact sound is generated from the sound wave input to the microphone 400 again after operation S222 is terminated and may notify the user of the fact that the impact sound is generated when the impact sound is generated.

In this case, in the method of notifying the user, the notification may be made by a text displayed on a display provided in the dishwasher or a voice output through a speaker provided in the dishwasher.

After operation S222 is terminated, when the impact sound is still generated, the controller 300 may stop the operation of the washing motor 65 and the spray nozzle for safety and notify the user of the fact that the impact sound is generated.

In the embodiment, when the impact sound is generated by the dish held on the rack and made of plastic or glass, the controller 300 may reduce the rotational speed of the washing motor to reduce the amount of impact applied to the dish by the washing water, and thus may effectively suppress the dish made of plastic or glass from being moved from an original location thereof or being damaged.

Figure 6:
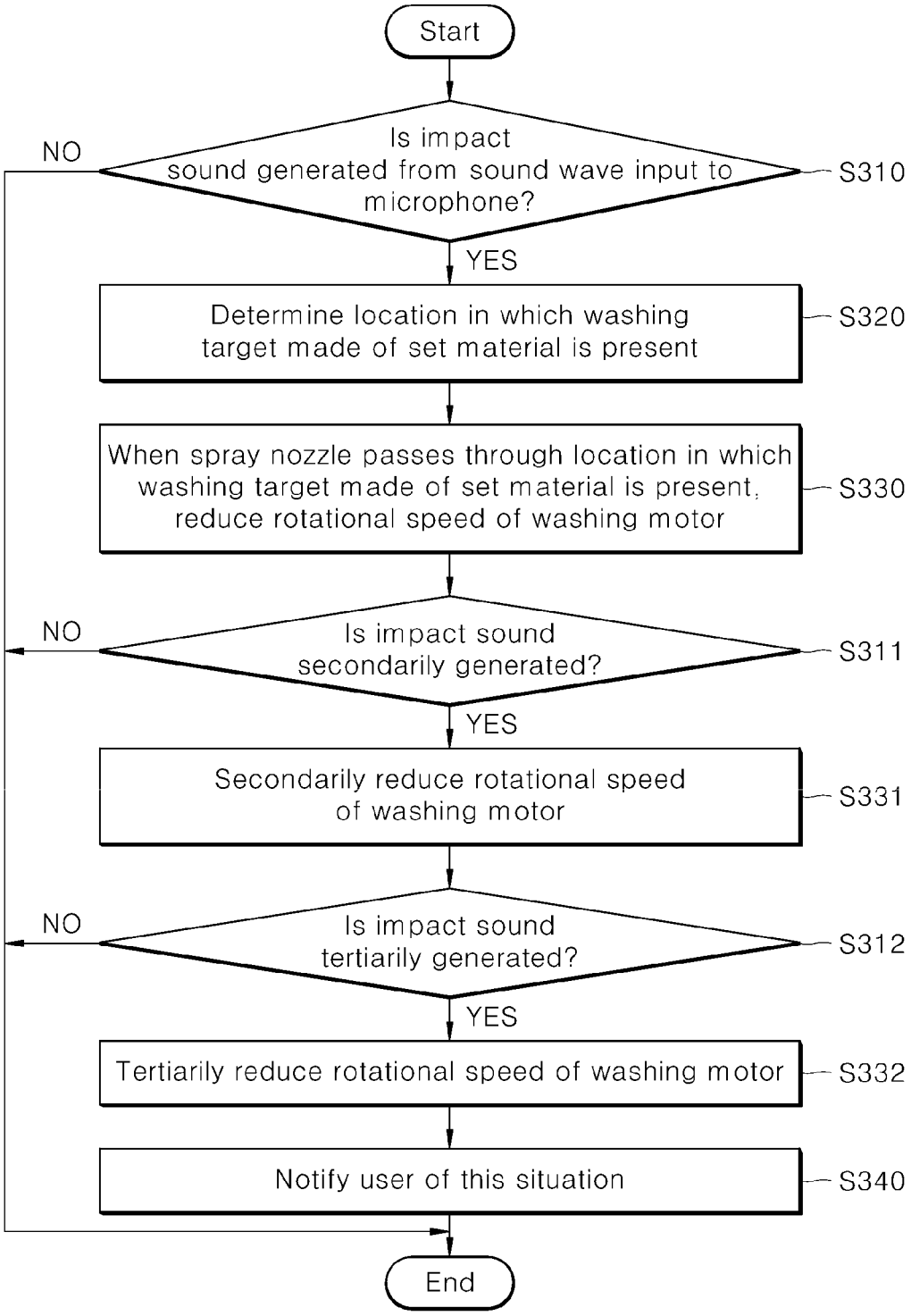
FIG. 6 is a flowchart for describing a method of controlling a dishwasher according to still another embodiment.

FIG. 6 is a flowchart for describing a method of controlling a dishwasher according to still another embodiment. FIG. 6 illustrates a method in which the controller 300 controls the rotational speed of the washing motor 65 according to still another embodiment.

The controller 300 may determine whether the impact sound is generated from the sound wave input to the microphone 400 (S310). Since operation S310 is an embodiment of operation S130 described above, operation S310 may be performed in operation S130 without a separate process. When the impact sound is not generated, the controller 300 may terminate the process without reducing the rotational speed of the washing motor 65.

When the impact sound is generated, the controller 300 may determine the location in which the washing target made of the set material is present (S320). Since operation S320 is an embodiment of operation S140 described above, operation S320 may be performed in operation S140 without a separate process. That is, the controller 300 may determine a location in which the impact sound is present as the location in which the dish made of the set material, that is, plastic or glass, is present.

When the spray nozzle passes through the location in which the washing target made of the set material is present, the controller 300 may reduce the rotational speed of the washing motor 65 on the basis of the location, derived in operation S320, in which the dish made of plastic or glass is present (S330).

The controller 300 may reduce the rotational speed of the washing motor 65 when the spray nozzle passes through the location in which the washing target made of the set material is present, and may restore the rotational speed of the washing motor 65 to an original speed when the spray nozzle deviates from the location. In this case, the original speed of the washing motor 65 may be the same as the rotational speed of the washing motor 65 when the washing target made of the set material is not present in the rack.

A time point when the spray nozzle passes through the location in which the washing target made of the set material is present may be provided by appropriately setting a range of the rotation angle of the spray nozzle with respect to a location in which the spray nozzle and the dish made of plastic or glass overlap each other in the vertical direction of the dishwasher.

The controller 300 may reduce the rotational speed of the washing motor 65 to reduce the amount of impact applied to the dish made of the specific material and caused by the washing water, thereby suppressing the movement or damage of the dish made of the specific material. A rotational speed reduction ratio of the washing motor 65 may be appropriately set.

In the embodiment, when the spray nozzle passes over the dish made of plastic or glass, the controller 300 may reduce the rotational speed of the washing motor 65, thereby reducing a washing time and increasing washing efficiency as compared to a case in which the overall rotational speed of the washing motor 65 is reduced uniformly.

In this case, the determination of whether the impact sound is generated and the reduction of the rotational speed of the washing motor 65 may be alternately performed multiple times. In the reduction of the rotational speed of the washing motor 65, the controller 300 may reduce the rotational speed of the washing motor 65 when the spray nozzle passes through the location in which the washing target made of the set material is present, and may restore the rotational speed of the washing motor 65 to an original speed when the spray nozzle deviates from the location. This control may be commonly performed in operation S330 and operations S331 and S332 described below.

The determination of whether the impact sound is generated and the reduction of the rotational speed of the washing motor 65 may be set to an appropriate number of times. In the embodiment, the number of repetitions is set to three, but the present disclosure is not limited thereto.

After performing operation S330, the controller 300 may secondarily determine whether the impact sound is generated from the sound wave input to the microphone 400 (S311). When the impact sound is not generated in operation S311, the controller 300 may terminate the process without reducing the rotational speed of the washing motor 65.

When the impact sound is generated, the controller 300 may secondarily reduce the rotational speed of the washing motor 65 (S331). In this case, the rotational speed of the washing motor 65 after operation S331 is terminated is further reduced as compared to the rotational speed of the washing motor 65 after operation S330 is terminated.

After performing operation S331, the controller 300 may tertiarily determine whether the impact sound is generated from the sound wave input to the microphone 400 (S312). When the impact sound is not generated in operation S312, the controller 300 may terminate the process without reducing the rotational speed of the washing motor 65.

When the impact sound is generated, the controller 300 may tertiarily reduce the rotational speed of the washing motor 65 (S332). In this case, the rotational speed of the washing motor 65 after operation S332 is terminated is further reduced as compared to the rotational speed of the washing motor 65 after operation S331 is terminated.

When the impact sound is generated even after the rotational speed of the washing motor 65 is reduced, the controller 300 may notify the user of this situation (S340).

In detail, the controller 300 may determine whether the impact sound is generated from the sound wave input to the microphone 400 again after operation S332 is terminated, and may notify the user of the fact that the impact sound is generated when the impact sound is generated.

Figure 7:
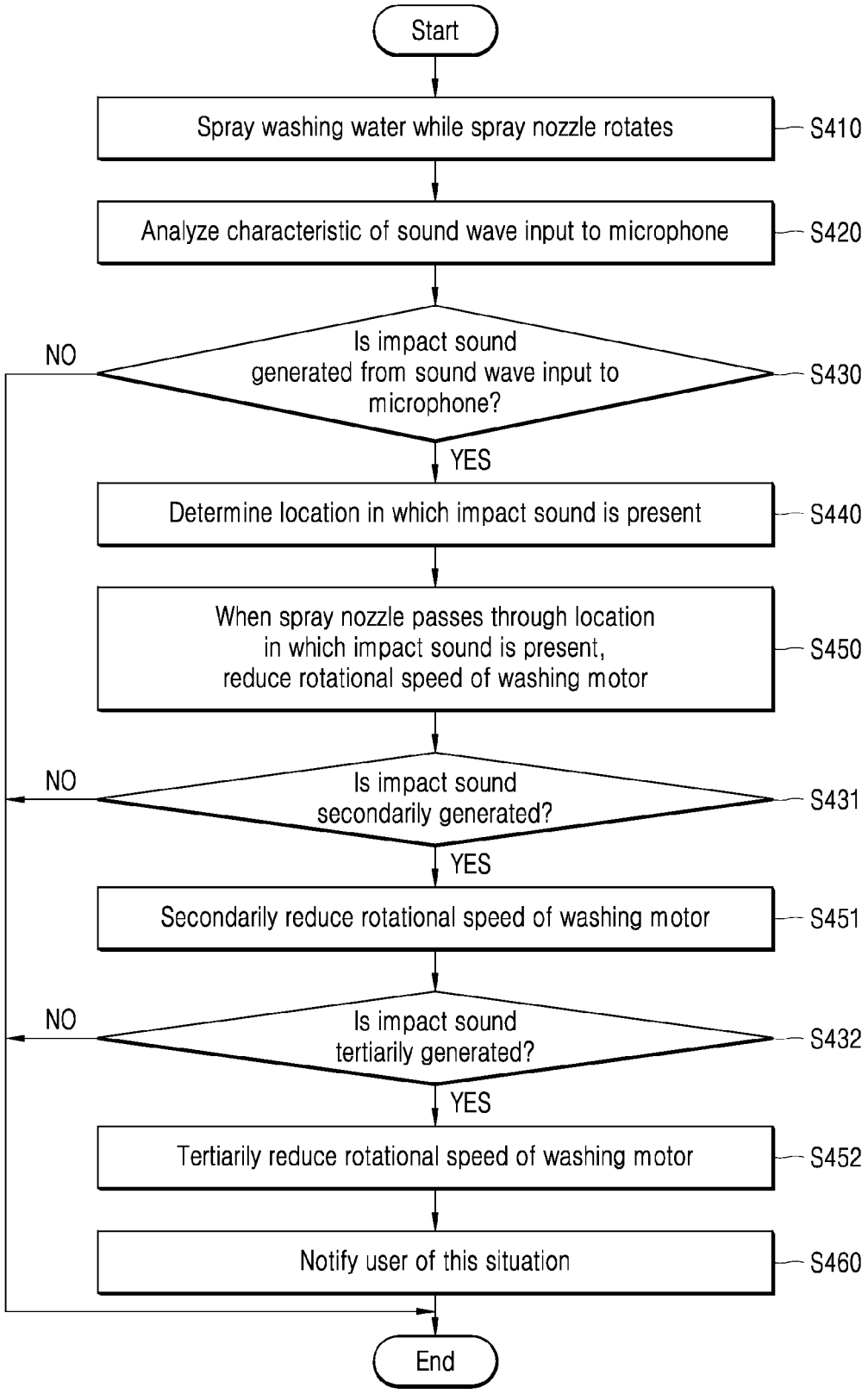
FIG. 7 is a flowchart for describing a method of controlling a dishwasher according to yet another embodiment.

FIG. 7 is a flowchart for describing a method of controlling a dishwasher according to still another embodiment. According to the method of controlling a dishwasher illustrated in FIG. 7, when the impact sound is generated in the dish held on the rack, the rotational speed of the washing motor 65 may be reduced to prevent the generation of the impact sound, thereby suppressing the movement and damage of the dish that generates the impact sound. Hereinafter, description of parts overlapping the above description may be omitted.

First, while the washing motor 65 is operated to rotate the spray nozzle, the washing water may be sprayed onto the dish held on the rack (S410). In this case, the microphone 400 provided in the washing chamber 16*a* may collect noise, that is, the sound wave, which is generated while the washing water collides with the dish.

The controller 300 may receive the sound signal from the microphone 400 and analyze characteristics of the sound wave input to the microphone 400 (S420). The controller 300 may analyze at least one of the amplitude or the frequency of the sound wave input to the microphone 400.

The controller 300 may determine whether the impact sound is generated from the sound wave input to the microphone 400 on the basis of the result obtained by analyzing the characteristics of the sound wave (S430). When the impact sound is not present, the process may be completed.

When the impact sound is present, the controller 300 may determine the location in which the impact sound is present (S440).

When the spray nozzle passes through the location in which the impact sound is present, the rotational speed of the washing motor 65 may be reduced (S450). In this case, the controller 300 may reduce the rotational speed of the washing motor 65 when the spray nozzle passes through the location in which the washing target made of the set material is present, and may restore the rotational speed of the washing motor 65 to an original speed when the spray nozzle deviates from the location. The reduction of the rotational speed of the washing motor 65 and the restoration may be common in operation S450 and operations S451 and S452 described below.

After performing operation S450, the controller 300 may secondarily determine whether the impact sound is generated from the sound wave input to the microphone 400 (S431). When the impact sound is not generated in operation S431, the controller 300 may terminate the process without reducing the rotational speed of the washing motor 65.

When the impact sound is generated, the controller 300 may secondarily reduce the rotational speed of the washing motor 65 (S451). In this case, the rotational speed of the washing motor 65 after operation S4511 is terminated is further reduced as compared to the rotational speed of the washing motor 65 after operation S450 is terminated.

After performing operation S451, the controller 300 may tertiarily determine whether the impact sound is generated from the sound wave input to the microphone 400 (S432). When the impact sound is not generated in operation S432, the controller 300 may terminate the process without reducing the rotational speed of the washing motor 65.

When the impact sound is generated, the controller 300 may tertiarily reduce the rotational speed of the washing motor 65 (S452). In this case, the rotational speed of the washing motor 65 after operation S452 is terminated is further reduced as compared to the rotational speed of the washing motor 65 after operation S451 is terminated.

When the impact sound is generated even after the rotational speed of the washing motor 65 is reduced, the controller 300 may notify the user of this situation (S460).

In detail, the controller 300 may determine whether the impact sound is generated from the sound wave input to the microphone 400 again after operation S451 is terminated and may notify the user of the fact that the impact sound is generated when the impact sound is generated.

As described above, the present disclosure has been described with reference to the accompanying drawings, but the present disclosure is not limited by the embodiments disclosed in the present specification and the drawings, and various modifications may be made by those skilled in the art within the scope of the technical spirit of the present disclosure. In addition, although the effects according to the configuration of the present disclosure have not been explicitly described while the embodiments of the present disclosure are described, it is apparent that the effects predictable by the corresponding configuration should also be recognized.

What is claimed is:

1. A method of controlling a dishwasher, wherein the dishwasher includes a tub that defines a washing chamber in which one or more washing targets are accommodated, at least one spray nozzle that is rotatably provided in the washing chamber and that is configured to spray washing water to the washing chamber, a rack that is accommodated in the washing chamber and that is configured to receive the one or more washing targets, and a microphone provided in the tub, the method comprising:

spraying, by the at least one spray nozzle, the washing water while the at least one spray nozzle is rotating;

analyzing a characteristic of a sound wave input to the microphone, the sound wave being generated based on the washing water colliding with the one or more washing targets;

determining whether a washing target made of a set material is present among the one or more washing targets based on the analyzed characteristic of the sound wave;

determining, based on determining that the washing target made of the set material is present, a location in which the washing target made of the set material is present according to the analyzed characteristic of the sound wave; and reducing an amount of impact applied to the washing target made of the set material by the washing water sprayed from the at least one spray nozzle, wherein analyzing the characteristic of the sound wave includes analyzing at least one of an amplitude or a frequency of the sound wave input to the microphone.

2. The method of claim 1, wherein determining whether the washing target made of the set material is present includes determining, based on the at least one of the amplitude or the frequency of the sound wave input to the microphone deviating from a set range, that the washing target made of the set material is present in the washing chamber, the set range being stored in a case in which the washing target made of the set material is not present.

3. The method of claim 1, wherein determining whether the washing target made of the set material is present includes determining, based on the at least one of the amplitude or the frequency of the sound wave input to the microphone being within a set range, that the washing target made of the set material is present in the washing chamber, the set range being stored in a case in which the washing target made of the set material is present.

4. The method of claim 1, wherein the set material of the washing target is made of at least one of plastic or glass.

5. The method of claim 4, wherein determining whether the washing target made of the set material is present includes determining, based on impact sound generated from the washing target made of plastic or glass being detected, that the washing target made of the set material is present.

6. The method of claim 5, wherein reducing the amount of impact includes reducing at least one of (i) a spray amount and a spray speed of the washing water sprayed from the at least one spray nozzle or (ii) a rotational speed of the at least one spray nozzle.

7. The method of claim 6, wherein the dishwasher further includes:

a washing pump that is connected to the at least one spray nozzle and that is configured to supply the washing water to the at least one spray nozzle, and a washing motor that is connected to the washing pump through a rotary shaft and that provides a rotational force to the washing pump, and wherein reducing the amount of impact includes controlling a rotational speed of the washing motor to reduce at least one of (i) the spray amount and the spray speed of the washing water sprayed from the at least one spray nozzle or (ii) the rotational speed of the at least one spray nozzle.

8. The method of claim 7, wherein controlling the rotational speed of the washing motor includes:

determining whether the impact sound is generated based on the sound wave input to the microphone, reducing, based on a determination that the impact sound is generated, the rotational speed of the washing motor, and notifying, based on a determination that the impact sound is generated after the rotation speed of the washing motor is reduced, a user.

9. The method of claim 8, wherein determining whether the impact sound is generated and reducing the rotational speed of the washing motor are alternately performed a plurality of times.

10. The method of claim 7, wherein the rack includes a plurality of racks provided in the washing chamber in a vertical direction, wherein the at least one spray nozzle includes a plurality of spray nozzles that are arranged to correspond to the plurality of racks in the vertical direction, and wherein whether the washing target made of the set material is present in any one rack among the plurality of racks is determined by identifying whether the impact sound is generated when one of the plurality of racks is operated.

11. The method of claim 10, wherein determining the location in which the washing target made of the set material is present includes determining, based on the plurality of spray nozzles rotating, that the washing target made of the set material is present on a same rack according to a rotation angle of the plurality of spray nozzles and a time point when the impact sound is generated.

12. The method of claim 11, wherein controlling the rotational speed of the washing motor includes:

determining whether the impact sound is generated based on the sound wave input to the microphone, determining, based on a determination that the impact sound is generated, the location in which the washing target made of the set material is present, reducing, based on at least one of the plurality of spray nozzles passes through the location in which the washing target made of the set material is present, the rotational speed of the washing motor, and notifying, based on a determination that the impact sound is generated after the rotational speed of the washing motor is reduced, a user.

13. The method of claim 12, wherein determining of whether the impact sound is generated and reducing the rotational speed of the washing motor are alternately performed a plurality of times.

14. The method of claim 11, wherein the dishwasher further includes a location sensor that is mounted on one of the plurality of spray nozzles and that is configured to detect a rotation angle of the one of the plurality of spray nozzles.

15. The method of claim 1, further comprising collecting, by the microphone, the sound wave that is generated based on the washing water colliding with the one or more washing targets.

16. The method of claim 10, wherein the plurality of racks include an upper rack and a lower rack, and the plurality of spray nozzles include an upper spray nozzle and a lower spray nozzle.

17. The method of claim 16, wherein the plurality of racks and the plurality of spray nozzles correspond to each other in the vertical direction.

18. The method of claim 17, wherein spraying the washing water includes spraying the washing water to the upper rack through the upper spray nozzle, and wherein determining the location includes determining that the location in which the washing target made of the set material is present is the upper rack based on impact sound generated by spraying the washing water to the upper rack.

19. The method of claim 17, wherein spraying the washing water includes spraying the washing water to the lower rack through the lower spray nozzle, and wherein determining the location includes determining that the location in which the washing target made of the set material is present is the lower rack based on impact sound generated by spraying the washing water to the lower rack.

* * * * *